US012129720B2

(12) United States Patent
Moscaritolo

(10) Patent No.: US 12,129,720 B2
(45) Date of Patent: Oct. 29, 2024

(54) CLAMPING HEAD ASSEMBLY FOR CLAMPING A DRILL PIPE ELEMENT

(71) Applicant: EURODRILL GmbH, Drolshagen (DE)

(72) Inventor: Tobias Moscaritolo, Meinerzhagen (DE)

(73) Assignee: EURODRILL GmbH, Drolshagen (DE)

( * ) Notice: Subject to any disclaimer, the term of this patent is extended or adjusted under 35 U.S.C. 154(b) by 0 days.

(21) Appl. No.: 18/463,192

(22) Filed: Sep. 7, 2023

(65) Prior Publication Data

US 2024/0084652 A1 Mar. 14, 2024

(30) Foreign Application Priority Data

Sep. 14, 2022 (EP) ..... 22195706

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/07; E21B 31/18; E21B 19/16
See application file for complete search history.

(56) References Cited

U.S. PATENT DOCUMENTS

| | | | |
|---|---|---|---|
| 7,775,270 | B1 | 8/2010 | Sipos |
| 2009/0057032 | A1 | 3/2009 | Angelle et al. |
| 2014/0332236 | A1 | 11/2014 | Park |

FOREIGN PATENT DOCUMENTS

| | | | |
|---|---|---|---|
| EP | 1 936 109 B1 | 5/2009 | |
| EP | 2322757 A2 * | 5/2011 | ..... E21B 19/16 |

OTHER PUBLICATIONS

The extended European search report issued by the European Patent Office on Jan. 27, 2023, which corresponds to European Patent Application No. EP 22 195 706.1-1002.

* cited by examiner

*Primary Examiner* — James G Sayre
(74) *Attorney, Agent, or Firm* — Studebaker & Brackett PC

(57) ABSTRACT

The invention relates to a clamping head assembly for clamping a drill pipe element, comprising a clamping head base, at least one clamping jaws base body which is radially adjustable at the clamping head base between a clamping position and a releasing position relative to the drill pipe element, and at least one adapter element at the clamping jaws base body, wherein the adapter element is adapted to a shape of the drill pipe element to be clamped and is configured to abut and clamp the drill pipe element in the clamping position. According to the invention, it is provided that the adapter element is releasably arranged on the clamping jaws base body and can be locked by means of an actuatable locking device, and that the locking device comprises at least one latch element adjustable between a locking position, in which the adapter element is locked and secured to the clamping jaws base body, and a release position, in which the adapter element is released and removable from the clamping jaws base body.

12 Claims, 5 Drawing Sheets

CLAMPING HEAD ASSEMBLY FOR CLAMPING A DRILL PIPE ELEMENT

BACKGROUND OF THE INVENTION

The invention relates to a clamping head assembly for clamping a drill pipe element, comprising a clamping head base, at least one clamping jaw base body which is radially adjustable at the clamping head base between a clamping position and a releasing position relative to the drill pipe element, and at least one adapter element at the clamping jaw base body, wherein the adapter element is adapted to a shape of the drill pipe element to be clamped and is configured to abut and clamp the drill pipe element in the clamping position, according to the preamble of claim 1.

A known clamping head assembly can be found, for example, in EP 1 936 109 B1. In this known assembly, a drill pipe element can be clamped and retained by three clamping jaws arranged offset by 120° to each other. Such clamping head assemblies are used in particular on drilling apparatuses in which the drill pipe is composed of several drill pipe elements and in particular screw-connected. In particular, when an additional drill pipe element is screwed on or when a drill pipe element is loosened during retraction from the borehole, such clamping head assemblies can be used, for example, for retaining the existing drill pipe so that it does not slip back into the borehole during retraction out of the borehole. The loosening and tightening of the screw connection within the drill pipe is also an important aspect here, as in the clamped state, the clamping jaws can transmit high torques via frictional force. Depending on the type of drilling apparatus, such a clamping head assembly can also be movable axially or radially.

The clamping head assembly comprises clamping jaws with a contact surface by means of which the clamping jaw makes contact over as large an area as possible with the outer circumference of the drill pipe. This allows the highest possible adhesive and frictional forces and thus the best possible retaining force on the drill pipe.

When the diameter of the drill pipe is changed, it is therefore common practice to replace the actual clamping jaws, which can also be referred to as adapter elements, and replace them with other clamping jaws whose contour is adapted to the changed outer circumference of the drill pipe.

For this purpose, it is known to loosen connecting devices on the clamping jaws, remove the existing clamping jaws and replace them with new clamping jaws. The connecting devices must then be closed again so that the clamping head assembly is ready for use again. These changes have to be carried out manually and require a considerable amount of time and effort.

SUMMARY OF THE INVENTION

The object underlying the invention is to specify a clamping head assembly by means of which adaptation to modified drill pipe elements can be carried out efficiently.

According to the invention, the object is achieved by a clamping head assembly having the features of claim 1. Preferred embodiments of the invention are given in the dependent claims.

The clamping head assembly according to the invention is characterized in that the adapter element is releasably arranged on the clamping jaw base body and can be locked by means of an actuatable locking device, and in that the locking device comprises at least one latch element adjustable between a locking position, in which the adapter element is locked and secured to the clamping jaw base body, and a release position, in which the adapter element is released and removable from the clamping jaw base body.

A basic idea of the invention is to mount the adapter element, which is the actual clamping jaw, releasably on a clamping jaw base body and to lock it by means of an actuatable locking device. Complex connecting devices, which in particular comprise screws, can thereby be omitted. Instead, an easy-to-operate and preferably automatically or semi-automatically actuated locking device with a latch element is provided. The latch element is adjustable between a locking position and a release position by a simple latching movement, in particular a linear or arcuate movement. The locking device on the clamping jaw base body can thus be used to quickly release and lock and thus efficiently change the adapter elements.

A preferred embodiment of the invention is that the clamping head base is of substantially cylindrical or tubular design. The clamping head base represents a base body or a frame on which the clamping jaws base bodies are mounted. The clamping head base may be annular or sleeve-shaped and encircle the drill pipe element on its outer side. Alternatively or in addition, the clamping head base can also be rod-shaped or similarly designed so that it can be arranged inside a tubular rod element. Depending on the design of the clamping head base, clamping can thus take place on the outside of the drill pipe element and/or on the inside of the drill pipe element.

In a simple embodiment, it may be sufficient that a single clamping jaw base body is arranged, which can be fed onto the drill pipe element with the clamping jaw or adapter element. According to a further development of the invention, it is particularly advantageous that a plurality of clamping jaw base bodies are arranged to be distributed over a circumference of the drill pipe element to be clamped. In particular, two, three or four or any other suitable number of clamping jaws base bodies with corresponding adapter elements can be arranged to be distributed over the circumference of the drill pipe element in one plane. In particular, the adapter elements are arranged opposite to one another in the radial direction so that abutment forces can cancel each other out.

According to another embodiment of the invention, it is advantageous that at least one latch element is biased by a biasing device and retained in the locking position. Preferably, all latch elements of the clamping head assembly are retained biased in the locking position. This ensures a Fail-Safe Operation. In this case, the biasing device can be, in particular, a tension spring by means of which the latch element is retained in the locking position by means of a spring force. Thus, to release the adapter element, the latching element must be actively moved into the releasing position with force against the biasing device. After the force is removed, the latch element returns to the locking position.

It is furthermore preferred that the at least one latch element comprises an actuating portion for adjusting the latch element from the locking position to the release position. In particular, the actuating portion can be a pin or a bolt, which preferably projects with respect to the base body of the clamping jaws. By actuating the actuating portion, in particular by applying a compressive force to the actuating portion, the latch element can be adjusted from the locking position to the release position.

In particular, according to one embodiment of the invention, it is advantageous that at least one latch element is displaceably mounted on or in a clamping jaws base body and that in the locking position, an actuating portion of the latch element projects with respect to the clamping jaws base body. The latch element can preferably be adjustably mounted on or in the clamping jaws base body in a corresponding receptacle. The actuating portion of the latch element can preferably project out of the receptacle so that the actuating portion can be actuated in a simple manner.

According to a further embodiment of the invention, it is preferred that the at least one clamping jaws base body is mounted to be axially displaceable and that a wedge gate valve mechanism is formed at the clamping head base, by means of which mechanism an axial movement of the at least one clamping jaws base body can be converted into a radial clamping movement. Guide bars oriented in particular obliquely to the longitudinal axis of the drill pipe can be arranged on the clamping head base or the clamping head base can be of conical design as a whole, so that an axial displacement of the clamping jaws base body in the longitudinal direction also results in a radial adjusting and clamping movement of the clamping jaws base body.

According to a further development, it is particularly advantageous that at least one stop is arranged on the clamping head base, against which an actuating portion of the latch element is movable, wherein the latch element can be adjusted from its locking position to the release position. In particular, during an axial movement, the actuating element can project forward in the direction of movement, so that the actuating element is pressed axially against a stop after a certain adjustment movement of the clamping jaws base body. The stop is arranged in such a way that the actuating portion does not come into contact with the stop during a normal axial clamping movement for clamping a drill pipe. Rather, this is only possible if no clamping of a drill pipe element is provided and accordingly no drill pipe is arranged in the clamping head assembly. The stop can thus be used to adjust the latch element from the locking position to the release position via the actuating element. In this position, the unlocked adapter element can then be removed from the clamping jaws base body and a new adapted adapter element inserted. Using this configuration, the actuating drive can be used for unlocking or locking, which is also provided for carrying out the clamping movement during drilling operation.

A preferred embodiment of the invention is, in particular that an adjusting device is arranged, in particular comprising at least one adjusting cylinder, by means of which the at least one clamping jaws base body is adjustable. The adjusting device can in particular comprise one or more hydraulic cylinders, which is preferably aligned parallel to the longitudinal axis of the drill pipe element to be clamped.

Another appropriate embodiment of the invention is that the adapter element comprises at least one retaining portion which projects into a recess in the base body of the clamping jaws, and that the at least one retaining portion is configured to cooperate with the at least one latch element of the clamping jaws base body for at least positively securing the adapter element to the clamping jaws base body. Preferably, securing can take place not only positively, but also non-positively.

In particular, it is advantageous that the retaining portion comprises a retaining pin on which a locking recess is formed, in which the latch element engages with a latch portion for positive locking in the locking position. A through hole or preferably an outer recess, in particular also an annular recess, can be arranged on the retaining portion, in which the latch element engages positively with at least one latch portion. This ensures reliable retaining of the adapter element on the clamping jaws base body.

Furthermore, according to one embodiment of the invention, it can be provided that the latch element comprises a release portion which, in the release position, is arranged on the locking recess in such a way that the adapter element with the retaining portion is removable from the base body of the clamping jaws. The latch element can in particular be a pin- or bolt-shaped latch element in which the release portion is formed by a recess. If this recess of the release portion is moved into the region of the locking recess of the retaining portion of the adapter element, the positive locking can thus be released. In this release position, the adapter element with the retaining portion can be released from the clamping jaws base body and removed.

The invention further comprises a drilling apparatus for making a borehole, in particular in a ground, comprising at least one drill pipe element, wherein the above-described clamping head assembly according to the invention is provided. With such a drilling apparatus, the above-described advantages can be achieved, in particular if the drill pipe is to be exchanged by one of a different outer diameter.

DESCRIPTION OF THE DRAWINGS

The invention is further described below with reference to preferred exemplary embodiments, which are shown schematically in the drawings. The drawings show in.

DETAILED DESCRIPTION OF THE INVENTION

Figure 1:
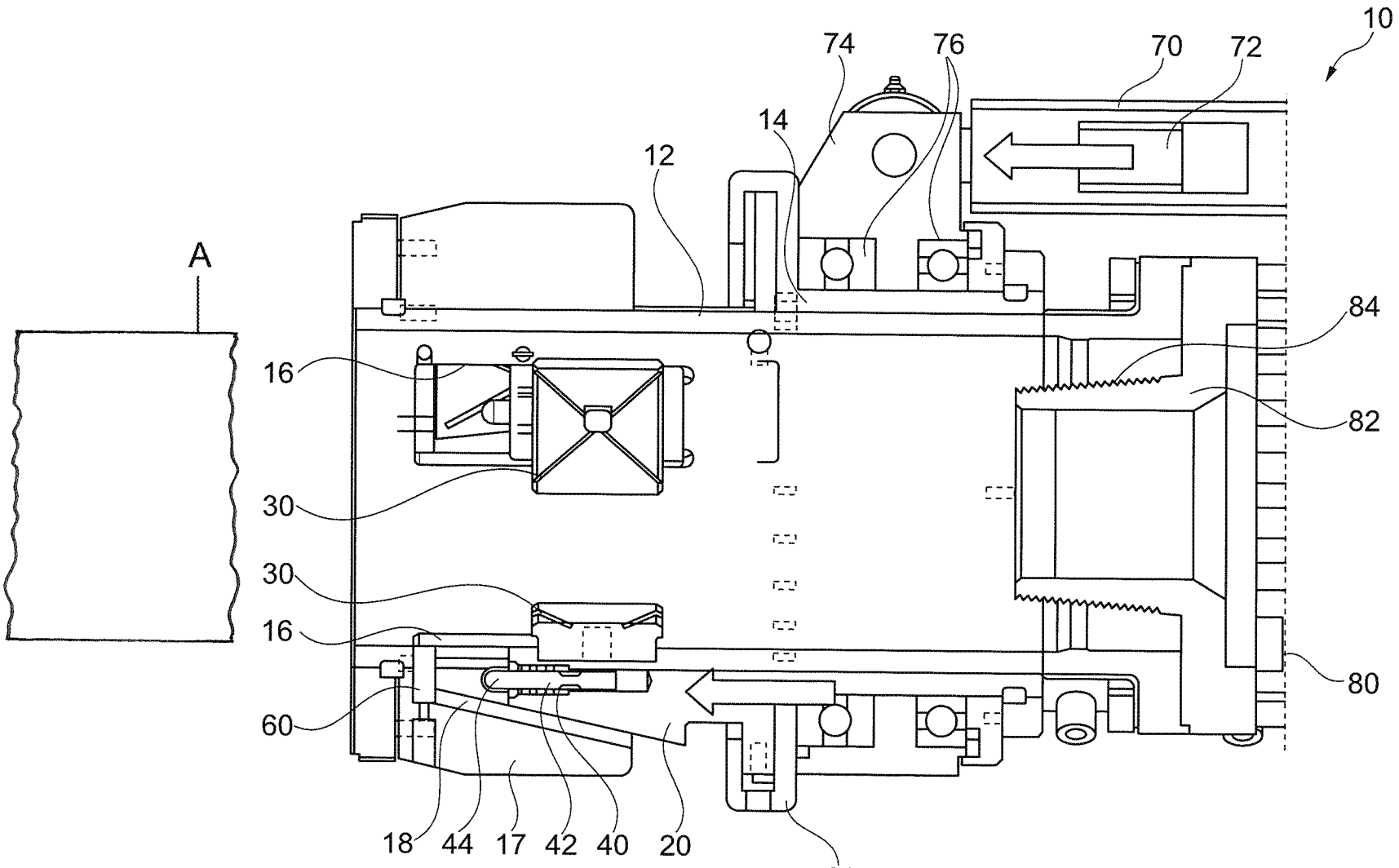
FIG. 1 a cross-sectional view through a clamping head assembly according to the invention.

FIG. 1 schematically shows a clamping head assembly 10 according to the invention with a sleeve-shaped clamping head base 12. The clamping head assembly 10 can be firmly attached to a partially indicated rotary drive 80 and in particular to a rotationally driven output element 82 with a connection piece with an external thread 84. The clamping head base 12 can thus rotate with the output element 82 of the rotary drive 80. A drill pipe A with a corresponding internal thread can be screwed on via the external thread 84 of the output element 82. The drill pipe A is arranged inside the sleeve-shaped clamping head base 12 and is partially shown in FIG. 1.

On the outside of the sleeve-shaped clamping head base 12, a clamping head carriage 14 is mounted axially displaceably. For axial displacement, an adjusting device 70 having one or more adjusting cylinders 72 can be arranged, as also shown schematically in FIG. 1. The adjusting device 70 can be fixedly attached to a base body (not shown), such as a drilling apparatus, and can be stationary relative to the rotating drive element 82. By means of the at least one adjusting cylinder 72, an actuator 74 can be displaced, which is connected to the axially movable clamping carriage 14 via pivot bearings 76. In this way, an axial actuating movement can be transmitted from the relatively fixed adjusting device 70 to the clamping carriage 14 rotating about a longitudinal and/or rotational axis at the clamping head base 12.

At a front side of the clamping carriage 14, one or more clamping jaws base bodies 20 can be connected to the clamping carriage 14 by means of an annular holder 22. The holder 22 can be configured in such a way that it creates an axially fixed connection with the at least one clamping jaws base body 20, but allows radial movement of the clamping jaws base body 20 with respect to the clamping head base 12 with respect to the longitudinal or rotational axis.

An outer side surface of the clamping jaws base body 20 is inclined or tapered so that it forms a wedge gate valve mechanism 18 with a corresponding inclined or conical guide element 17, which is fixedly attached to the outer side of the clamping head base 12. The wedge gate valve mechanism 18 is configured in such a way that during an axial advance movement of the clamping carriage 14, the clamping jaws base body 20 is adjusted not only axially but also in a defined manner in a radial direction, in particular radially inwards.

Plate-like adapter elements 30, preferably arc-shaped on their inner side and adapted to the drill pipe A element to be clamped, are arranged on the clamping jaws base body 20 on the radial inner side. The adapter elements 30 extend through window-like passages 16 in the clamping head base 12 from the clamping jaws base body 20 attached to the radial outer side into the inner space of the sleeve-shaped clamping head base 12. The caused radial movement of the clamping jaws base bodies 20 with the adapter elements 30 attached thereto allows radial force-fit clamping of a cylindrical drill pipe element arranged in the clamping head base 12. By returning the clamping carriage 14 by means of the adjusting device 70, the clamping jaws base body 20 with the adapter element 30 is radially returned again, wherein the clamping of a drill pipe element is released.

In accordance with the invention, the adapter elements 30 are each releasably and replaceably retained on the clamping jaws base body 20 by means of a locking device 40, wherein the locking device 40 has a bolt-like latch element 42 arranged parallel to the longitudinal or rotational axis and having a pin-like actuating portion 44 which projects axially with respect to an end face of the associated clamping jaws base body 20.

To release the locking device 40, the clamping jaws base body 20 can be moved up to a forward end position at which the actuating portion 44 of the latch element 42 is pressed against an axial stop 60. The operation of the locking device 40 is described in greater detail below in conjunction with the further Figures.

Figure 2:
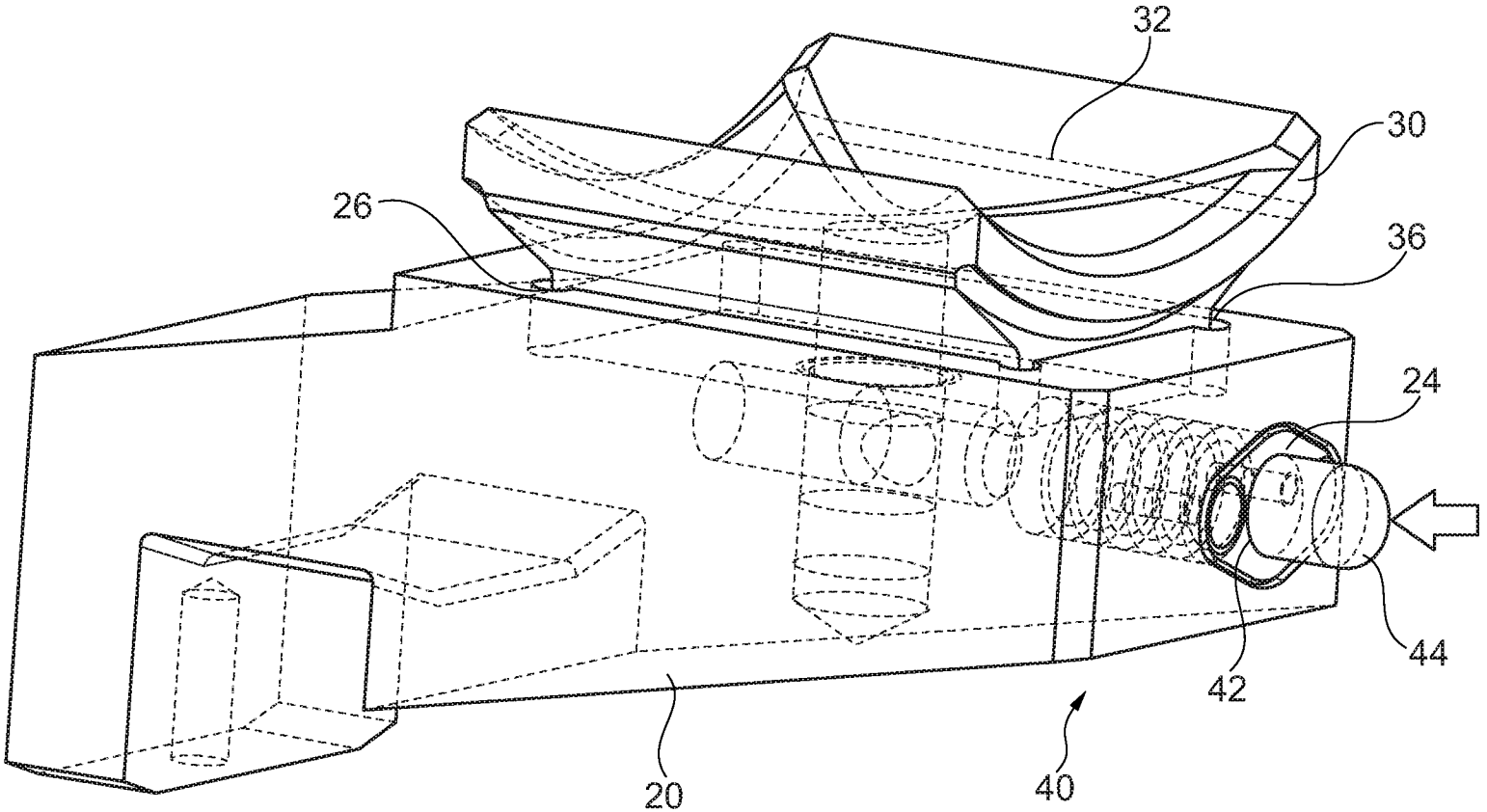
FIG. 2 a perspective view of a clamping jaws base body with the adapter element being inserted in locking position.

FIG. 2 shows an enlarged view of a clamping jaws base body 20. The clamping jaws base body 20 has a recess 26 into which the adapter element 30 with a retaining portion 36 is fittingly inserted. FIG. 2 also shows that the adapter element 30 has an arcuate clamping surface 32 on its upper side, the contour of which is adapted to an outer contour of a cylindrical drill pipe element to be clamped.

The locking device 40 with a bolt-shaped latch element 42 is arranged inside the clamping jaws base body 20. The latch element 42 is displaceably mounted and retained in a receiving bore in the clamping jaws base body 20 via a screwed fastening plate 24, wherein a pin-like actuating portion 44 with a dome-shaped head projects in a defined manner from the latch element 42 out of the clamping jaws base body 20.

Figure 3:
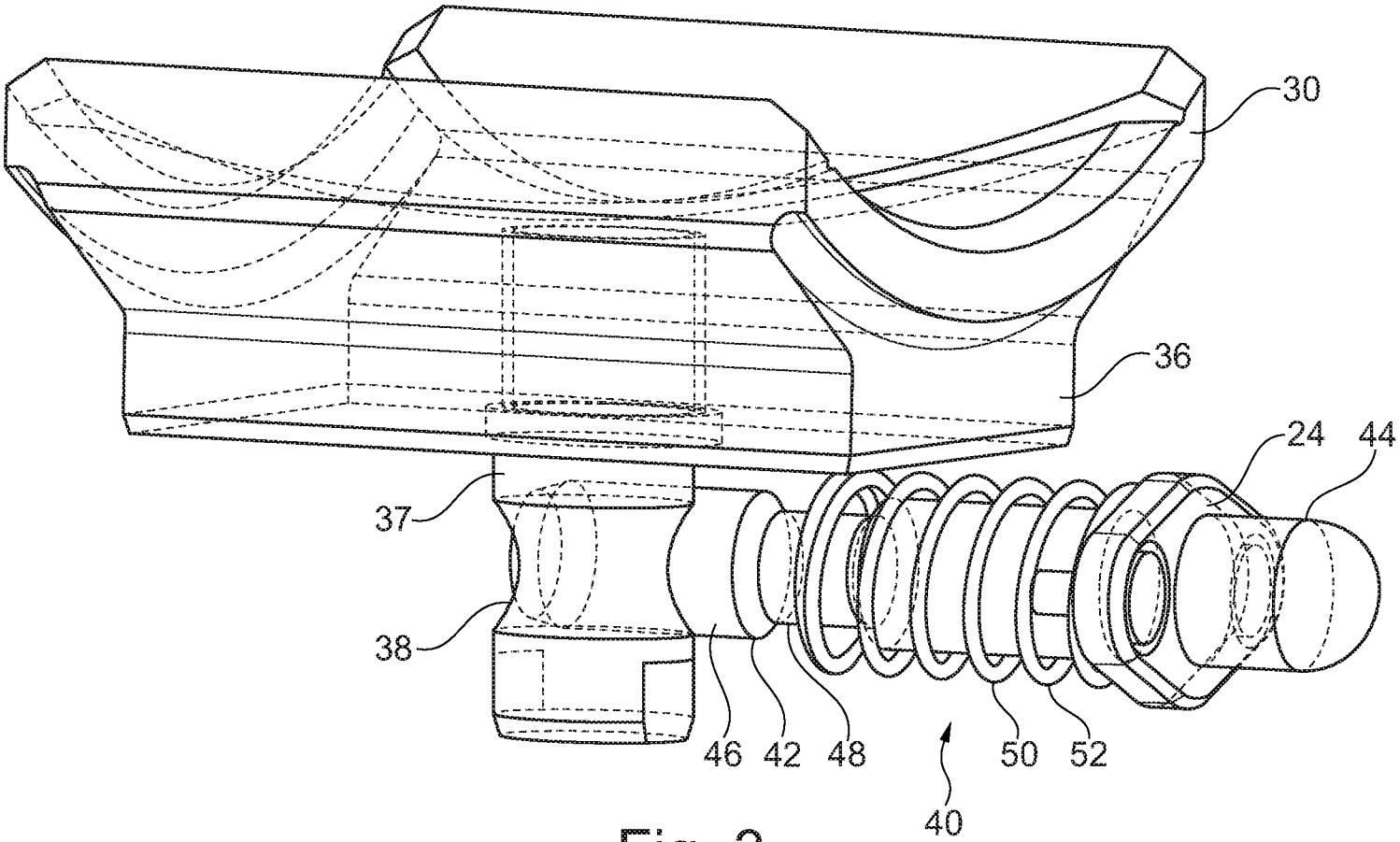
FIG. 3 a perspective view of the adapter element with the associated latch element in the locking position without the clamping jaws base body.
Figure 4:
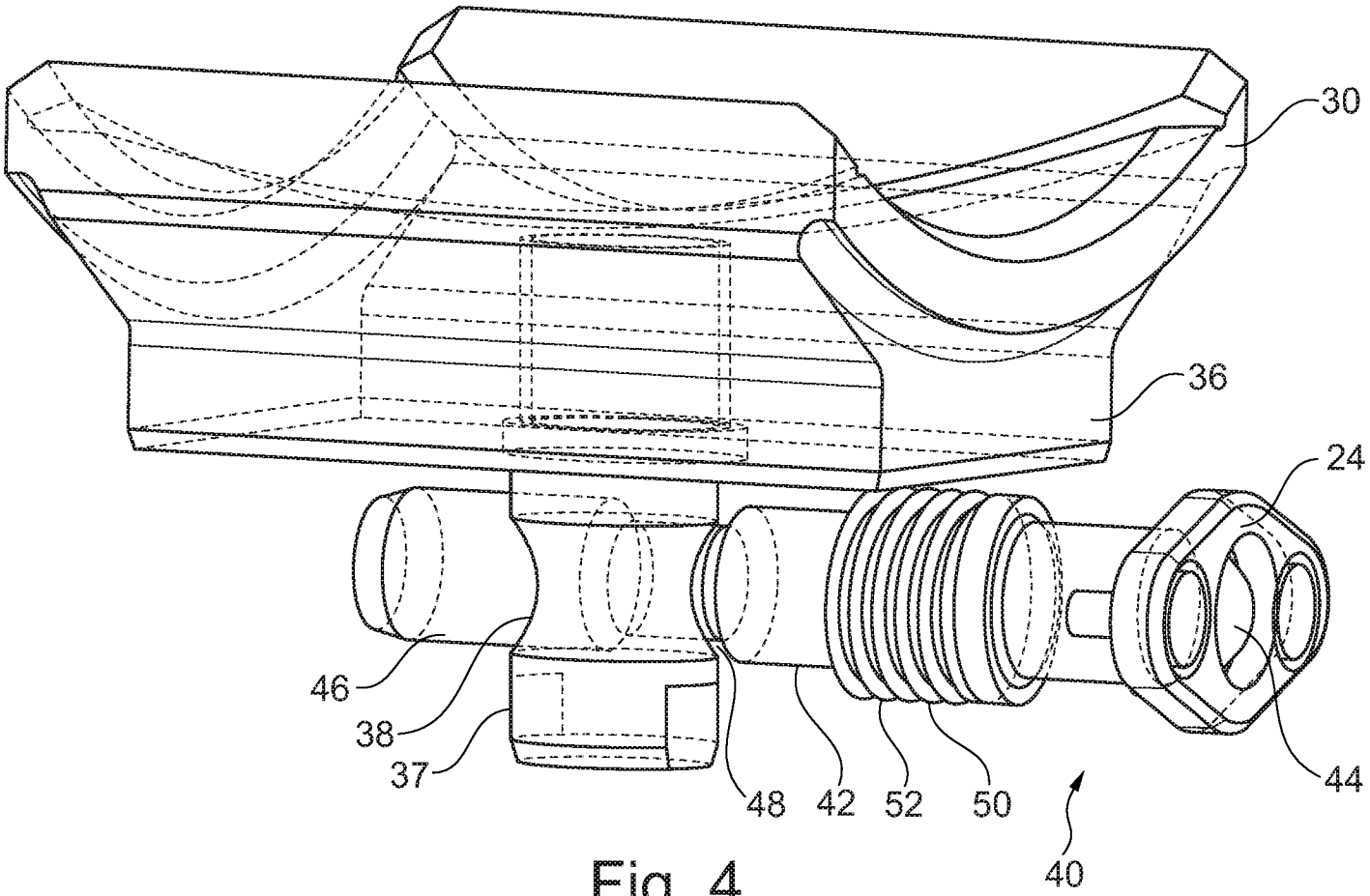
FIG. 4 a perspective view of adapter element and latch element corresponding to in FIG. 3, but in a release position of the latch element.

The design and operation of the locking device 40 are explained in greater detail in conjunction with the schematic illustrations of FIGS. 3 and 4. For reasons of clarity, only the adapter element 30 and the locking device 40 are shown, but not the surrounding clamping jaws base body 20.

FIG. 3 shows the locking device 40 in its locked position. The bolt-shaped latch element 42 is retained in the locking position by a biasing device 50, which can be configured as a helical spring 52 according to the exemplary embodiment shown. In the process, a latch portion 46 of the latch element 42 engages in an annular groove-shaped locking recess 38 of a retaining pin 37, which is formed on an underside of the retaining portion 36 of the adapter element 30. The retaining pin 37 is thereby received in a corresponding receiving bore within the clamping jaws base body 20. Thus, in this arrangement, the retaining pin 37 is retained positively by the latch portion 46 engaging in the locking recess 38. In this locking position, the front actuating portion 44 of the latch element 42 projects axially in a defined manner relative to the fastening plate 24 attached to the clamping jaws base body 20.

Figure 5:
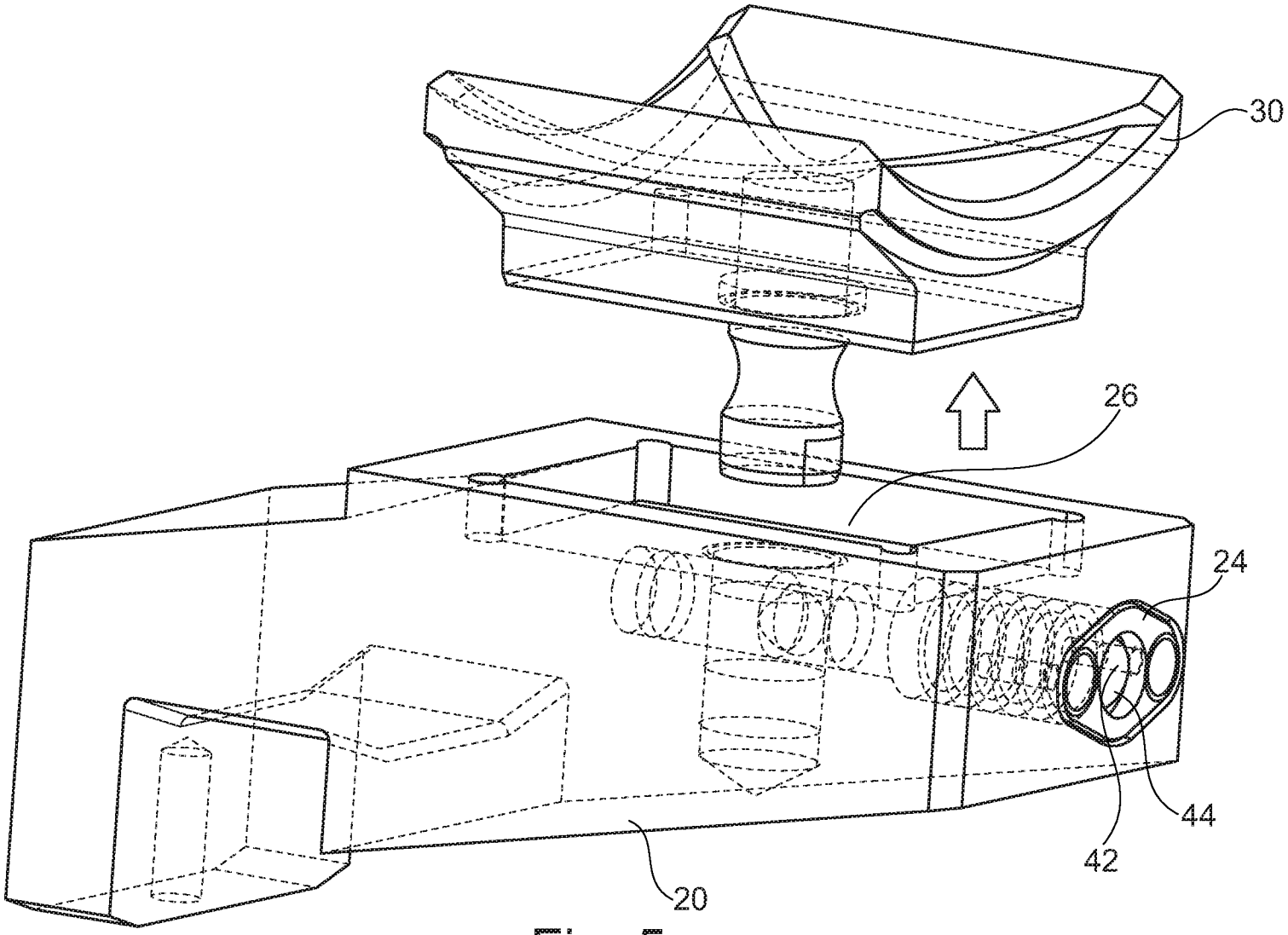
FIG. 5 a perspective view of the clamping jaws base body according to FIG. 2 when the adapter element is removed in the release position.

If the clamping jaws base body 20 is now moved axially against the stop 60 as shown in FIG. 1, the actuating portion 44 and thus the latch element 42 are pressed inwards into a release position, which is shown schematically in FIG. 4. During this actuating movement, the larger diameter latch portion 46 disengages from the locking recess 38. Further, as the latch element 42 is displaced into the area of the locking recess 38 on the retaining pin 37, a release portion 48 of the latch element 42 is pushed. The release portion 48 is smaller in diameter than the adjacent latch portion 46. The release portion 48 is configured in such a way that the retaining pin 37 is no longer positively blocked and the adapter element 30 can therefore be pulled upwards out of the recess 26 on the clamping jaws base body 20, as shown in FIG. 5. In this release position, a new adapter element 30 can then be inserted into the clamping jaws base body 20, which preferably has a different arc-shaped contour of the clamping surface 32.

After inserting the new adapter element 30, the clamping jaws base body 20 can be pushed away from the stop 60 again with the adjusting device 70 as shown in FIG. 1, wherein the bolt-shaped latch element 42 is adjusted. In the process, the latch element 42 is returned to the locking position by the biasing device 50 compressed in the release position by the helical spring 52. The latch element 42 returns again to the position according to FIG. 3.

FIG. 5 schematically shows the removal of the adapter element 30 from the approximately rectangular recess 26 on the clamping jaws base body 20. It is further evident from FIG. 5 that in this release position according to FIG. 4, the latch element 42 is pressed with the actuating portion 44 into the receiving bore in the clamping jaws base body 20, wherein the actuating portion 44 does not project relative to the face side of the clamping jaws base body 20 with the fastening plate 24.

The invention claimed is:

1. A clamping head assembly for clamping a drill pipe element comprising a clamping head base, at least one clamping jaws base body which is radially adjustable at the clamping head base between a clamping position and a releasing position relative to the drill pipe element, and at least one adapter element on the clamping jaws base body, wherein the adapter element is adapted to a shape of the drill pipe element to be clamped and is configured to abut and clamp the drill pipe element in the clamping position, wherein the adapter element is releasably arranged on the clamping jaws base body and can be locked by means of an actuatable locking device, the locking device comprises at least one latch element adjustable between a locking position, in which the adapter element is locked and secured to the clamping jaws base body, and a release position, in which the adapter element is released and removable from the clamping jaws base body, the at least one clamping jaws base body is mounted to be axially displaceable, and a wedge gate valve mechanism is formed on the clamping head base, by means of which mechanism an axial movement of the at least one clamping jaws base body can be converted into a radial clamping movement.

2. The clamping head assembly according to claim 1, wherein the clamping head base is of substantially cylindrical or tubular design.

3. The clamping head assembly according to claim 1, wherein a plurality of clamping jaws base bodies are arranged to be distributed over a circumference of the drill pipe element to be clamped.

4. The clamping head assembly according to claim 1, wherein at least one latch element is biased and retained in the locking position by a biasing device.

5. The clamping head assembly according to claim 1, wherein the at least one latch element comprises an actuating portion for adjusting the latch element from the locking position to the release position.

6. The clamping head assembly according to claim 1, wherein the at least one latch element is mounted displaceably on or in a clamping jaws base body, and in the locking position, an actuating portion (44) of the latch element projects with respect to the clamping jaws base body.

7. The clamping head assembly according to claim 1, wherein at least one stop is arranged on the clamping head base, against which stop an actuating portion of the latch element is movable, wherein the latch element is adjustable from its locking position to the release position.

8. The clamping head assembly according to claim 1, wherein the adapter element comprises at least one retaining portion which projects into a recess in the clamping jaws base body, and the at least one retaining portion is configured to cooperate with the at least one latch element of the clamping jaws base body for at least positively securing the adapter element to the clamping jaws base body.

9. The clamping head assembly according to claim 8, wherein the retaining portion comprises a retaining pin on which a locking recess is formed, in which the latch element engages with a latch portion for positive locking in the locking position.

10. The clamping head assembly according to claim 9, wherein the latch element comprises a release portion which, in the release position, is arranged on the locking recess in such a way that the adapter element with the retaining portion is removable from the clamping jaws base body.

11. A drilling apparatus for making a borehole, in particular in a ground, comprising at least one drill pipe element, wherein a clamping head assembly according to claim 1 is provided.

12. A clamping head assembly for clamping a drill pipe element comprising a clamping head base, at least one clamping jaws base body which is radially adjustable at the clamping head base between a clamping position and a releasing position relative to the drill pipe element, and at least one adapter element on the clamping jaws base body, wherein the adapter element is adapted to a shape of the drill pipe element to be clamped and is configured to abut and clamp the drill pipe element in the clamping position, wherein the adapter element is releasably arranged on the clamping jaws base body and can be locked by means of an actuatable locking device, the locking device comprises at least one latch element adjustable between a locking position, in which the adapter element is locked and secured to the clamping jaws base body, and a release position, in which the adapter element is released and removable from the clamping jaws base body, and an adjusting device, in particular having at least one adjusting cylinder, is arranged, by means of which device the at least one clamping jaws base body is adjustable.

* * * * *